11/25/86 XR 4,625,144

United States Patent [19]

Kornaker

[11] Patent Number: 4,625,144

[45] Date of Patent: Nov. 25, 1986

[54] COLOR-PICTURE TUBE WITH CORRECTION MAGNETS IN ELECTRON GUN SYSTEM FOR TWIST CORRECTION

[75] Inventor: Walter Kornaker, Berkheim, Fed. Rep. of Germany

[73] Assignee: International Standard Electric Corporation, New York, N.Y.

[21] Appl. No.: 492,068

[22] Filed: May 6, 1983

[30] Foreign Application Priority Data

May 27, 1982 [DE] Fed. Rep. of Germany ..... 3219954

[51] Int. Cl.[4] ..... H01J 29/51

[52] U.S. Cl. ..... 313/412; 313/413; 313/414; 313/431

[58] Field of Search ..... 313/412, 414, 413, 428, 313/431, 433

[56] References Cited

U.S. PATENT DOCUMENTS

| | | | |
|---|---|---|---|
| 4,362,964 | 12/1982 | Sakurai et al. | 313/414 |
| 4,377,767 | 3/1983 | Kornaker | 313/412 |
| 4,439,710 | 3/1984 | Osakabe et al. | 313/414 |

*Primary Examiner*—Palmer C. DeMeo

*Attorney, Agent, or Firm*—Donald J. Lenkszus

[57] ABSTRACT

In addition to the correction magnets commonly used in the electron-gun system of a color-picture tube for color purity and dynamic convergence, one or more additional correction magnets are fixed in or on the electron-gun system. During final adjustment of the color-picture tube, the usual and additional correction magnets are adjusted in turn using the same magnetizer.

24 Claims, 16 Drawing Figures

Fig.6
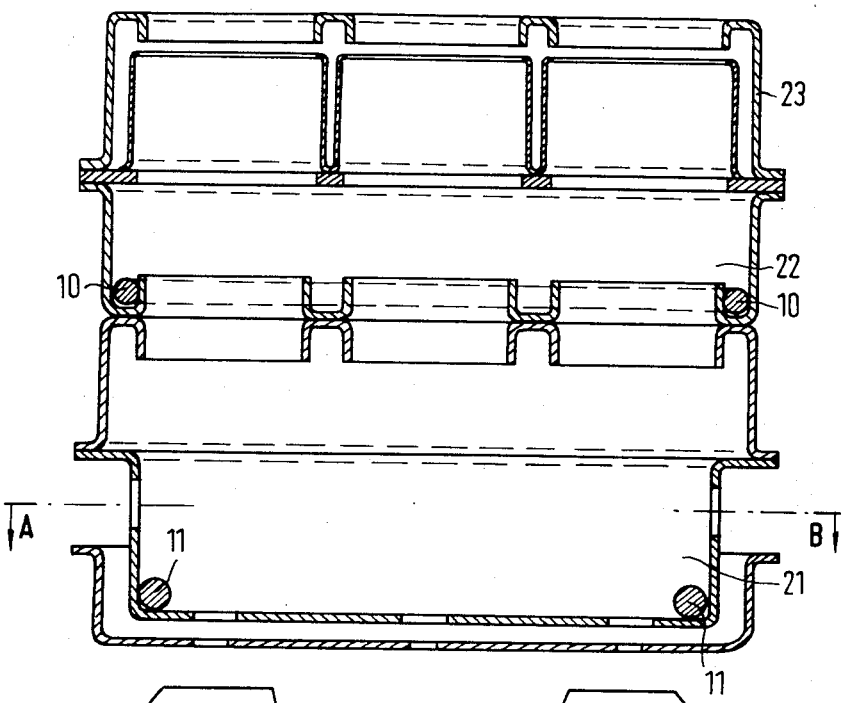
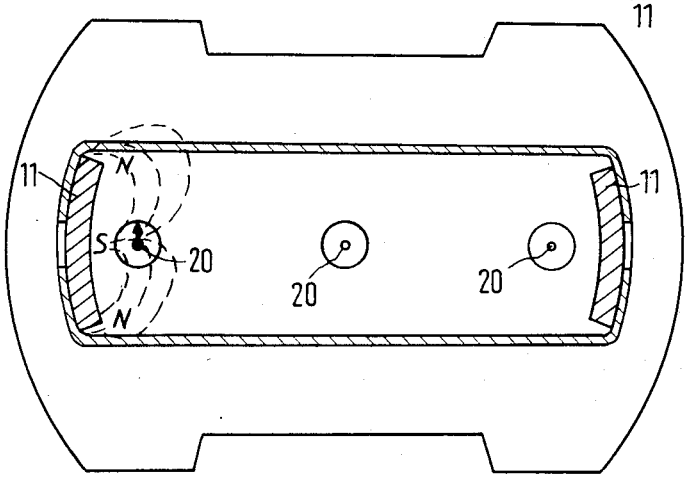
FIG.6A

COLOR-PICTURE TUBE WITH CORRECTION MAGNETS IN ELECTRON GUN SYSTEM FOR TWIST CORRECTION

BACKGROUND OF THE INVENTION

The prevent invention relates to a color-picture tube comprising a faceplate, a funnel, and a neck, wherein the faceplate is provided with a phosphor screen and a mask, and the neck houses an electron-gun system with at least one correction magnet.

In television receivers with color-picture tubes, the picture is produced by horizontal and vertical deflection of three electron beams which meet in the plane of the aperture mask and, emerging from the screen side of the mask, diverge and excite their assigned phosphor areas deposited side by side on the screen, which is just behind the mask.

Static convergence is maintained if the three electron beams converge at the center of the mask when there are no scanning forces. Static color purity is obtained if the three electron beams are directed so that each strikes only its assigned phosphor area on the screen. Dynamic convergence and color purity are maintained if the three beams remain converged at the screen as they are deflected over the screen.

Present-day combinations of a color-picture tube and a deflection unit are self-convergent, i.e., they are designed so that dynamic convergence and color purity are ensured without additional correcting currents in the deflection coils of the deflection unit.

However, this imposes stringent requirements on the precision of the color-picture tube manufacture, for the structure of the tube must be reproduced with high accuracy to implement the self-convergence.

Manufacturing variations cannot be kept within arbitrarily close limits even at high cost. The remaining variations should therefore be correctable.

For color purity and convergence, this is done, for example, with a ring of easily magnetizable permanent-magnet material mounted just behind the deflection unit on or in the electron-gun system. The ring is magnetized so that the electron beams are subjected to the necessary corrective deflections.

Particularly in the case of in-line guns with unitized construction, this correction is difficult if the dynamic convergence errors are due to the fact that the axes of one or both of the outer guns do not lie in the common horizontal plane.

This deviation, the so-called twist error, is caused by the fact that the lines written by the three electron beams during scan are inclined with respect to each other. Correction of the consequence of this deviation with the aid of the above-mentioned multipolar magnetized ring is not possible because the reduction of the twist error causes other dynamic errors. Thus, color-picture tubes with such constructional defects have to be subsequently improved by replacing the electron-gun system.

SUMMARY OF THE INVENTION

An object of the present invention is to provide a low-cost device for correcting twist errors.

A feature of the present invention is the provision of a color-picture tube comprising a faceplate including a phosphor screen and a mask; a neck portion including therein an electron-gun system having a cathode area for emission of three electron beams and at least one color purity and dynamic convergence correction magnet through which the electron beams pass; a funnel portion interconnecting the faceplate and the neck portions; and at least one additional color purity and dynamic convergence correction magnet disposed in the electron-gun system between the one correction magnet and the cathode area. In a color-picture tube with a twist error, the electron beams to be corrected are deflected by additional correction magnets before entering the magnetic field of the deflection unit and passing through the magnetic fields for adjusting color purity and convergence.

These additional correction magnets are mounted near the outer electron beams and are so magnetized that the beams can be deflected in different directions, i.e., from the plane in which the three electron guns lie. The central electron beam is to be unaffected by the correction magnets.

The magnetization of the additional correction magnets during the manufacture of color-picture tubes may take place on the automatic machine used to adjust other correction magnets.

To this end, a circle of magnetizing coils with sharply focused magnetic fields is movable in the direction of the longitudinal axis of the color-picture tube to the place of the correction magnets to be magnetized. The effects of the magnetizations are measured with sensors disposed in front of the screen, and further magnetizations are then carried out until the correction magnets have the magnetization required.

The use of additional magnets for correcting twist errors is advantageous with regard to the total manufacturing costs, since the number of color-picture tubes rejected because of uncorrectable dynamic errors of the screen image can be reduced considerably.

BRIEF DESCRIPTION OF THE DRAWING

Above-mentioned and other features and objects of this invention will become more apparent by reference to the following description taken in conjunction with the accompanying drawing, in which:

FIGS. 6 and 6A are respectively a longitudinal and transverse cross-sectional views of a first embodiment of the arrangement of the additional correction magnets in the electron-gun system in accordance with the principles of the present invention;

DESCRIPTION OF THE PREFERRED EMBODIMENTS

Figure 1:
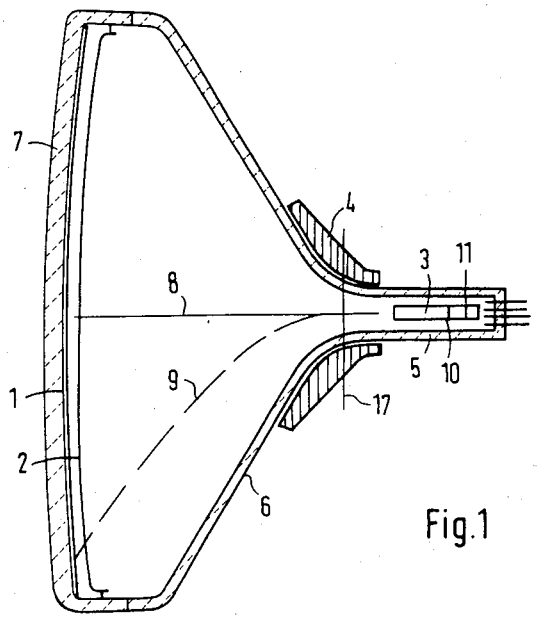
FIG. 1 is a schematic illustration of a color-picture tube with deflection unit in accordance with the principles of the present invention.
Figure 2:
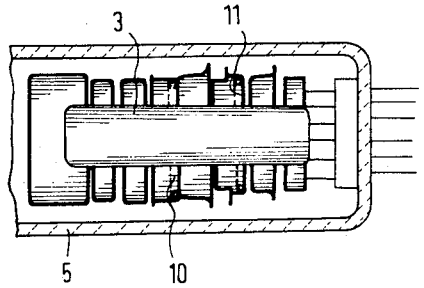
FIG. 2 is a schematic illustration of the electron-gun system of the color-picture tube of FIG. 1.

The color-picture tube of FIG. 1 comprises the faceplate 7 with the phosphor screen 1 and the mask 2, the funnel 6, and the neck 5, which houses the electron-gun system 3. FIG. 2 schematically illustrates electron-gun system 3 in an enlarged view. System 3 includes a correction magnet 10 for correcting color purity and convergence, and an additional correction magnet 11, which makes the purity and convergence correction of magnet 10 twist-error-free. The distance between magnets 10 and 11 can be in the order of at least 6 millimeters.

Figure 3:
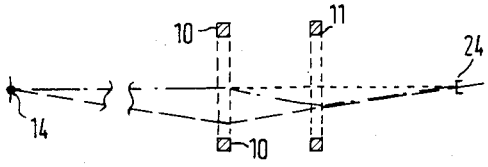
FIG. 3 shows the path of a corrected electron beam in a conventional color-picture tube and the path of an electron beam corrected in accordance with the present invention.

In FIG. 3 the path of an electron beam corrected for convergence with only one correction magnet 10 and requiring correction is indicated by a dashed line, and the path of an electron beam corrected with two correction magnets 10 and 11 in accordance with the present invention to eliminate the twist error is indicated by a dash-dot line. The dashed path is obtained if one correction magnet 10 is present. The dash-dotted path is obtained if the additional correction magnet 11 is provided in addition to the correction magnet 10. The path from the cathode 24 to the correction magnet 10 of an electron beam requiring no correction is shown dotted. Both beam paths shown in FIG. 3 end at the center 14 of the screen. However, during the deflection of the electron beam by magnetic fields of the deflection unit, differences result from the two paths shown because the beams enter the deflecting field in different positions, through which they pass beyond the correction magnets (see FIG. 1, where the deflection unit producing the deflecting field is designated 4).

Figure 4:
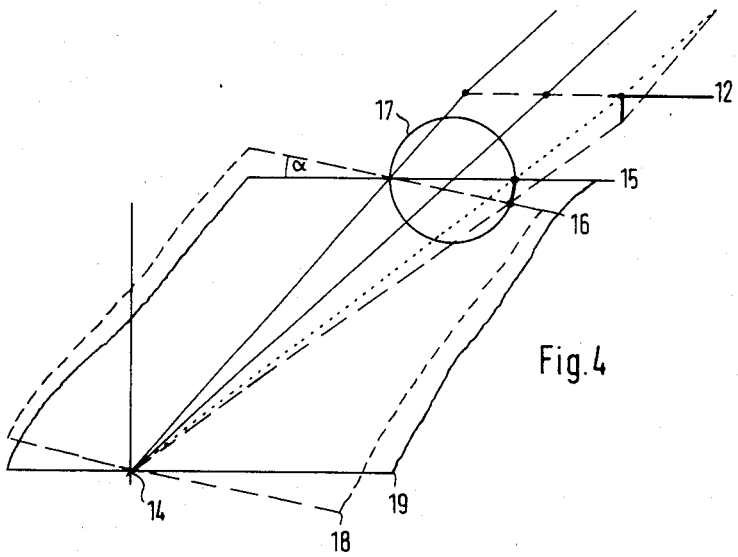
FIG. 4 is a perspective representation of the three electron beams with conventional convergence correction.

As shown in FIG. 4, convergence correction in conventional color-picture tubes is performed with the correction magnet 10, which lies in a plane containing the line 12. In the arrangement according to the invention, shown in FIG. 5, twist-error-free convergence correction is provided by an additional correction magnet 11, which lies in a plane containing the line 13.

FIG. 4 shows how the beams are deflected without the correction magnets 11. A horizontal plane 19 through the center 14 of the screen, which also contains the axes of the electron guns if the latter are positioned properly, intersects the middle plane 17 of the deflection unit 4 along the line 15. If the path of either of the outer electron beams differs from the dotted, desired path, the beam will be deflected toward the center 14 of the screen by the magnetic field of the correction magnet 10, but it will not follow the dotted, desired path. As a result, the beam will be deflected incorrectly in the magnetic field of the deflection unit, so that during horizontal deflection, it will not remain in the plane 19 but move within a plane 18, which is inclined to the plane 19 at the twist angle $\alpha$ and intersects the middle plane 17 of the deflection unit 4 along the line 16. This results in dynamic distortions on the entire screen 1.

Figure 5:
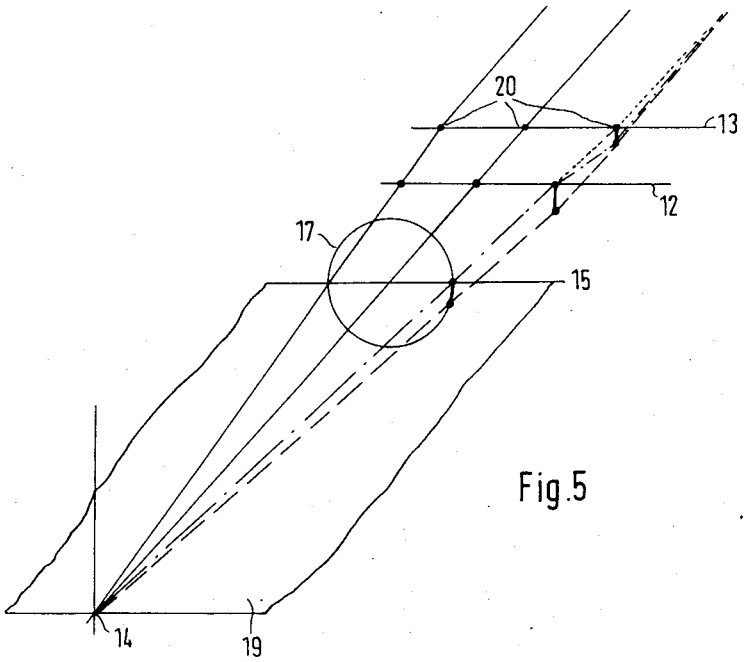
FIG. 5 is a perspective representation of the three electron beams with one of the beams corrected in accordance with the present invention to eliminate twist errors.

FIG. 5 shows how the dash-dotted, initially erroneous electron path is deflected towards the plane 19 by the correction magnets 11 according to the invention, which lie in a plane containing the line of intersection 13. The deflection of the electron beam into the plane 19 is caused by the correction magnet 10, which lies in the plane containing the line of intersection 12. The corrected beam then proceeds along the dash-dotted, desired path into the magnetic field of the deflection unit and, thus, causes no dynamic distortions during deflection. The dashed line indicates the path of an electron beam corrected by only one correction magnet 10. The dotted line indicates the path of an electron beam requiring no correction.

FIG. 6 shows a first embodiment of the arrangement of the additional correction magnets 11. The openings 20, through which the outer electron beams enter the grid G3, lie in the range of action of the correcting magnets 11, which may be I-, U- or E-shaped. The correction magnets 11 are preferably fixed positively or nonpositively in the lower part 21 of the grid G3 of the electron-gun system. The central part 22 of the grid G3 contains the correction magnets 10.

Figure 7:
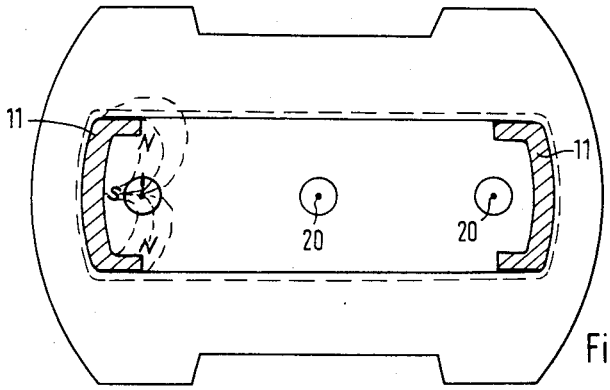
FIG. 7 is a transverse cross-sectional view of a second embodiment of the arrangement of the additional correction magnets in accordance with the principles of the present invention.
Figure 8:
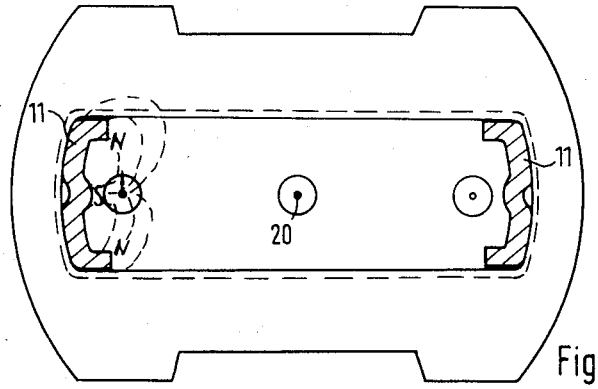
FIG. 8 is a transverse cross-sectional view of a third embodiment of the arrangement of the additional correction magnets in accordance with the principles of the present invention.

FIG. 7 shows a second embodiment with a U-shaped correction magnet 11, and FIG. 8 shows a second embodiment with an E-shaped correction magnet 11.

Figure 9:
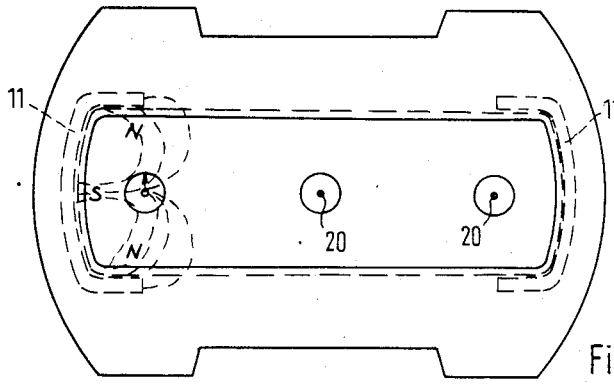
FIG. 9 is a transverse cross-sectional view of a fourth embodiment of the arrangement of the additional correction magnets on the outside of the grid in accordance with the principles of the present invention.

As shown in FIG. 9, the correction magnets 11 may also be attached to the outside of the grid G3. Corresponding arrangements inside or on the outside of the grid G2 are also possible.

Figure 10:
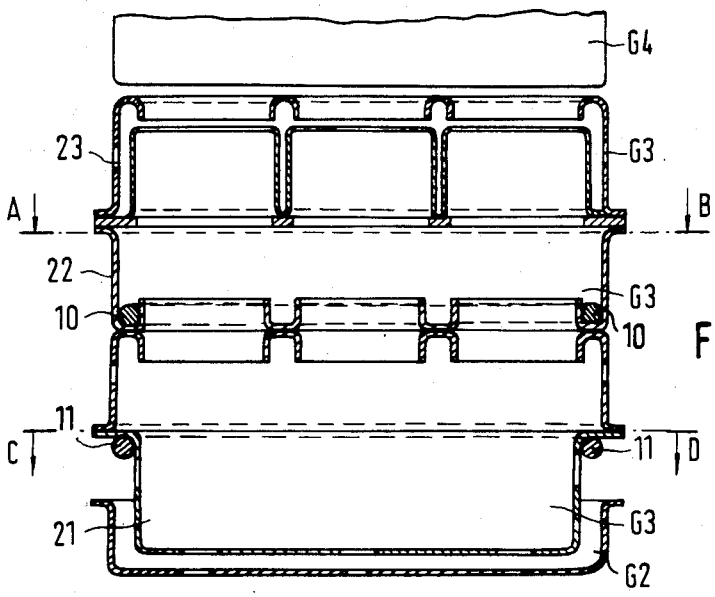
FIG. 10 is a longitudinal cross-sectional view through grid No. 2 and grid No. 3 of the electron-gun system with correction magnets located inside and on the outside of grid No. 3 in accordance with the principles of the present invention.
Figure 11:
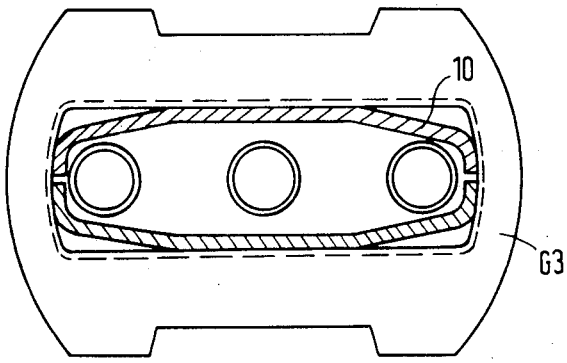
FIG. 11 is a transverse cross-sectional view taken along line A–B of the electron-gun system of FIG. 10.
Figure 12:
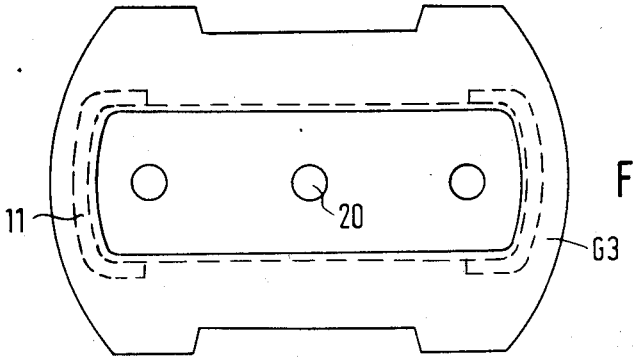
FIG. 12 is a transverse cross-sectional view taken along line C–D of the electron-gun system of FIG. 10.

FIG. 10 illustrates an example of the closely adjacent attachment of the correction magnets 10 in the form of clasps inside the grid G3, and of the additional correction magnets 11 in the form of U-shaped stirrups on the outside of the grid G3. The shapes of the correction magnets are apparent from FIGS. 11 and 12 where FIG. 11 is a transverse cross-section taken along line A–B of FIG. 10, and FIG. 12 is a transverse cross section taken along C–D of FIG. 10.

Figure 13:
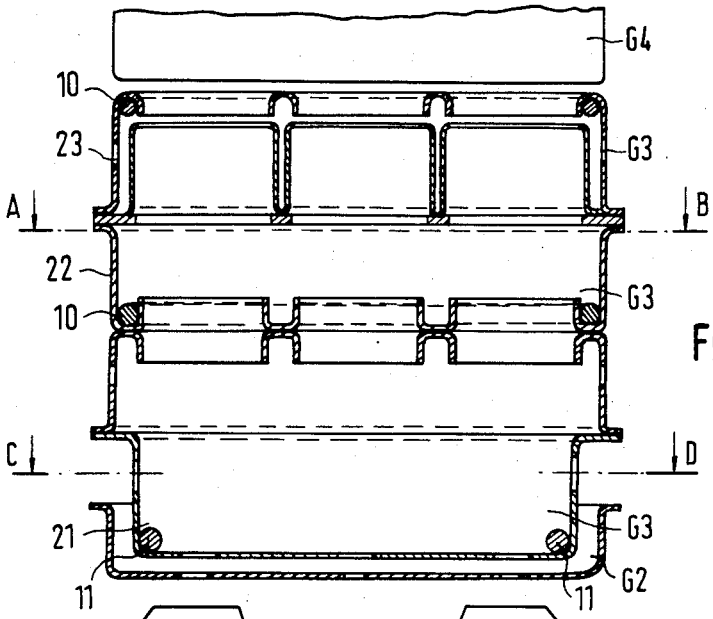
FIG. 13 is a longitudinal cross-sectional view through grid No. 2 and grid No. 3 of the electron-gun system with correction magnets located inside grid No. 3 in accordance with the principles of the present invention.
Figure 14:
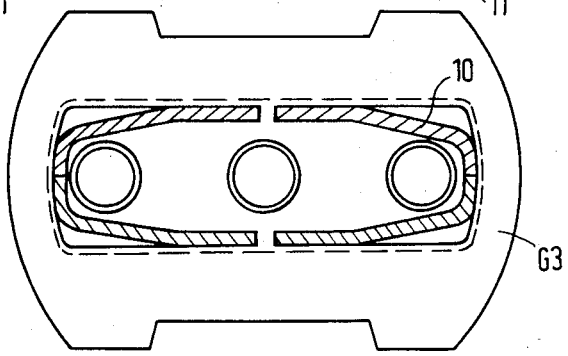
FIG. 14 is a transverse cross-sectional view taken along line A–B of the electron-gun system of FIG. 13.

FIG. 13 shows a structure with correction magnets 10 in two planes and with correction magnets 11 in one plane. In FIG. 14, a transverse cross-section taken along line A–B of FIG. 13, it can be seen that the correction magnets 10 in the central part of the grid G3 are separated by air gaps, while FIG. 15, a transverse cross-section taken along line C–D of FIG. 13, shows I-shaped correction magnets 11, with two basic forms of magnetization illustrated symbolically. The magnetization shown on the left, with three magnetic poles, causes the electron beam to be moved perpendicular to the plane of the electron beams, while the magnetization indicated on the right-hand side of FIG. 15, with two magnetic poles, causes the adjacent electron beam to be deflected in the horizontal direction.

Due to manufacturing errors and tolerances, the electron-gun system 3 may be so mounted in the neck 5 of the color-picture tube that one or both of the outer electron guns are twisted out of the desired plane. The deflection unit 4 is aligned precisely in relation to the desired horizontal position of this plane, so that electron beams deviating from this desired position will enter the magnetic field of the deflection unit. The resulting twist angle $\alpha$ leads to dynamic convergence errors.

By magnetizing the additional correction magnets 11 and the correction magnets 10 in turn, the twist error is eliminated. The twist correction is "dosed" by magnetizing the correction magnets 10 and 11 to different degrees. The electron path is thus deflected twice, so that not only the direction of the path but also the position of the beam is corrected.

Simultaneous correction of the paths of the two outer electron beams is possible and desirable but, in view of the satisfactory effect of the asymmetrical correction, not absolutely necessary. It may suffice to influence only one outer beam, i.e., to use the two-pole field of only one correction magnet 11 if this field is suitably positioned relative to the electron beam.

The correction magnet(s) 11 located inside the electron-gun system is (are), for example, a length (lengths) of wire preferably fixed at the lower inside edge of grid G3.

If these lengths of wire, which act exclusively on the outer electron beams, are suitably magnetized, twist-error-free convergence correction is possible. The magnetization can be performed with the coils already present for magnetizing the correction magnets 10. To this end, the coils are temporarily brought into the plane of the correction magnets 11. Instead of the two lengths of wire, use may be made of magnetic stirrups having one or more air gaps if a closely defined, i.e., sharply localized magnetization of the stirrups near the outer beam-scan be achieved with the coils.

Lengths of the wire or stirrups are mounted positively or nonpositively on the inside or outside of the grid G3. The shapes of the correction magnets and their geometric positions on the longitudinal axis of the electron-gun system depend on the characteristics of the respective type of color-picture tube and may differ from the embodiment shown in FIG. 6. Correction magnets 11 may also be located, for instange, in the upper part 23 of the grid G3 if the correction magnets 10 are in the grid G4, the so-called convergence cup.

The additional cost incurred by the additional correction magnets 11 is low, so that all color-picture tubes can be fitted with the correction magnets 11 during manufacture. In this manner, more than half of the rejects due to twist errors, which would necessitate sealing on a new electron-gun system, can be avoided.

Figure 15:
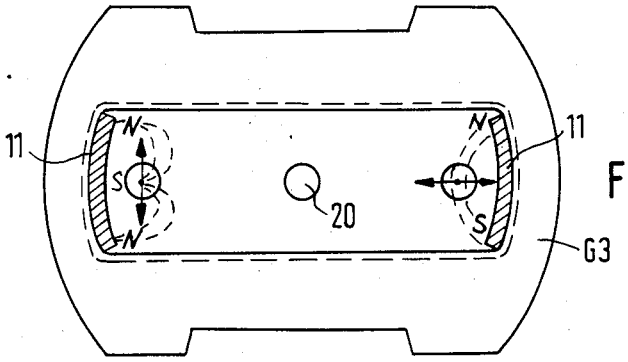
FIG. 15 is a transverse cross-sectional view taken along line C–D of the electron-gun system of FIG. 13.

To correct the twist error caused by the left-hand outer electron beam in FIG. 15, the left-hand correction magnet 11 is magnetized so that its magnetic field acting on the electron beam lies in the plane of the electron beams.

The magnetic field then moves the beam out of this plane, as indicated in FIG. 15 on the left by the arrows. The correction magnet on the right-hand side in FIG. 15 is magnetized so that in the position of the adjacent outer beam, a magnetic field is present perpendicular to the plane of the beams. With this magnetic field, the beam is deflected in the plane of the beams to assist the color-purity and convergence correction.

If the two magnetization patterns are superimposed on each other at the same correction magnet, the adjacent electron beam can be bent in any direction, i.e., the outer beams can be deflected in all directions between vertical and horizontal.

While I have described above the principles of my invention in connection with specific apparatus it is to be clearly understood that this description is made only by way of example and not as a limitation to the scope of my invention as set forth in the objects thereof and in the accompanying claims.

I claim:

1. A color-picture tube comprising:

a faceplate including a phosphor screen and a mask;

a neck portion including therein an electron-gun system having a cathode area for emission of first and second outer electron beams and a center electron beam disposed intermedate said first and second outer electron beams, at least one grid having side walls and at least one color purity and dynamic convergence correction magnet through which said electron beams pass;

a funnel portion in connecting said faceplate and said neck portions; and at least a first additional correction magnet located at said side walls of said grid and disposed in said electron-gun system between said one correction magnet and said cathode area, said first additional correction magnet being positioned near said first outer electron beam and magnetized to correct for twist errors, said center electron beam not being affected by said first additional correction magnet.

2. A tube according to claim 1, comprising:

a second additional correction magnet disposed at said grid side walls, said second additional correction magnet being positioned near said second outer electron beam and magnetized to correct for twist errors, said center electron beam not being affected by said second additional correction magnet.

3. A tube according to claim 2 wherein:

said first and second additional correction magnets are separated from said one correction magnet by at least 6 millimeters.

4. A tube according to claim 3, wherein said first additional correction magnets are I-shaped.

5. A tube according to claim 3, wherein said first additional correction magnets are U-shaped.

6. A tube according to claim 3, wherein said first additional correction magnets are E-shaped.

7. A tube according to claim 2, wherein said first additional correctional magnets are I-shaped.

8. A tube according to claim 2, wherein said first additional correction magnets are U-shaped.

9. A tube according to claim 2, wherein said first additional correction magnets are E-shaped.

10. A tube according to claim 1, wherein said first additional correction magnet is I-shaped.

11. A tube according to claim 1, wherein said first additional correction magnet is U-shaped.

12. A tube according to claim 1, wherein said first additional correction magnet is E-shaped.

13. A tube according to claim 1, wherein said first additional correction magnet and said one correction magnet are separated by at least 6 millimeters.

14. A tube according to claim 13, wherein said first additional correction magnet is I-shaped.

15. A tube according to claim 13, wherein said first additional correction magnet is U-shaped.

16. A tube according to claim 13, wherein said first additional correction magnet is E-shaped.

17. A tube according to claim 1, wherein said first and second additional correction magnets are disposed on the outside of said grid of said electron-gun system.

18. A tube according to claim 17, wherein said first and second additional correction magnets and said one correction magnet are separated by at least 6 millimeters.

19. A tube according to claim 18, wherein said first and second additional correction magnets are I-shaped.

20. A tube according to claim 18, wherein said first and second additional correction magnets are U-shaped.

21. A tube according to claim 18, wherein said first and second additional correction magnets are E-shaped.

22. A tube according to claim 17, wherein said first and second additional correction magnets are I-shaped.

23. A tube according to claim 17, wherein said first and second additional correction magnets are U-shaped.

24. A tube according to claim 17, wherein said first and second additional correction magnets are E-shaped.

* * * * *